US005673601A

United States Patent [19]

Ejima et al.

[11] Patent Number: 5,673,601

[45] Date of Patent: Oct. 7, 1997

[54] BREAKTHROUGH BUFFER FOR PRESSES AND CONTROL METHOD THEREFOR

[75] Inventors: Kikuo Ejima; Kenji Nishikawa; Kazuya Imamura; Kazuhisa Suzuki, all of Hiratsuka; Shigeki Iwasaki, Komatsu; Tatsunori Suwa, Hiratsuka, all of Japan

[73] Assignee: Komatsu Ltd., Tokyo, Japan

[21] Appl. No.: 381,856

[22] PCT Filed: Jul. 28, 1993

[86] PCT No.: PCT/JP93/01063

§ 371 Date: Feb. 7, 1995

§ 102(e) Date: Feb. 7, 1995

[87] PCT Pub. No.: WO94/05488

PCT Pub. Date: Mar. 17, 1994

[30] Foreign Application Priority Data

Sep. 2, 1992 [JP] Japan ..... 4-259067

[51] Int. Cl.[6] ..... B26D 5/12

[52] U.S. Cl. ..... 83/13; 83/72; 83/75; 83/639.1; 83/639.5; 100/35; 100/50; 72/17.2; 72/19.8

[58] Field of Search ..... 83/72, 76.7, 639.1, 83/639.5, 74, 75, 13, 30; 100/35, 48, 50, 299; 72/16.1, 17.2, 19.8, 31.01, 455

[56] References Cited

U.S. PATENT DOCUMENTS

| | | | |
|---|---|---|---|
| 3,827,328 | 8/1974 | LaFlamme et al. | 83/639.1 X |
| 4,116,122 | 9/1978 | Linder et al. | 83/72 X |
| 4,214,496 | 7/1980 | Carrieri | 83/639.5 X |
| 4,633,720 | 1/1987 | Dybel et al. | 72/31.01 X |
| 4,833,884 | 5/1989 | Seko et al. | 83/639.5 X |
| 4,945,742 | 8/1990 | Schoch | 72/17.2 X |
| 5,299,478 | 4/1994 | Schorn et al. | 83/74 X |
| 5,345,861 | 9/1994 | Brewer et al. | 72/455 X |
| 5,361,615 | 11/1994 | Kirii et al. | 72/19.8 X |
| 5,390,574 | 2/1995 | Schorn | 83/76.9 X |

FOREIGN PATENT DOCUMENTS

| | | | |
|---|---|---|---|
| 52-19376 | 2/1977 | Japan . | |
| 60-21832 | 5/1985 | Japan . | |
| 61-13928 | 4/1986 | Japan . | |
| 4-94197 | 8/1992 | Japan . | |
| 0745706 | 7/1980 | U.S.S.R. | 100/48 |
| 0789284 | 12/1980 | U.S.S.R. | 100/48 |

*Primary Examiner*—Rinaldi I. Rada
*Assistant Examiner*—Boyer Ashley
*Attorney, Agent, or Firm*—Sidley & Austin

[57] ABSTRACT

A breakthrough buffer for a mechanical press (1) includes at least one buffer body (20) disposed between punch slide (2) and lower press frame (7) to cushion punch plate (3) during breakthrough of punch (4) through a workpiece, a timing regulator (40, 70, 90) connected to each buffer body for regulating timing of buffering during breakthrough, and a control system (60) to provide a command signal to this regulator to minimize noise or vibration occurring during the breakthrough. The control system includes a controller (63) which is responsive to the output of noise sensor (61) or vibration sensor (65) during breakthrough. The buffer body can include fluid driven buffer piston (22) in a buffer cylinder (21), with the buffer piston being associated with a guidepost (5). Alternatively, the buffer body can include piston (82) which contacts the guidepost and which is fluid driven (30, 81) in opposition to spring (83). The timing regulator can include an annular guide (46, 71) which is movable vertically by stepping motor (41) and worm gear drive (42, 44). A locking mechanism (73) can restrain trailing whirl of the guide. Alternatively, the timing regulator can include regulating piston (94) in regulating actuator (93), with fluid pressure on one side being controlled by proportional valve (91) responsive to the command signal, while fluid pressure on the other side is applied to each buffer piston.

16 Claims, 9 Drawing Sheets

BREAKTHROUGH BUFFER FOR PRESSES AND CONTROL METHOD THEREFOR

TECHNICAL FIELD

The present invention relates to a breakthrough buffer for presses and to a control method therefor, and particularly to improvements of a breakthrough buffer for presses, for reducing noise occurring during blanking using a mechanical press, and to a control method therefor.

BACKGROUND ART

Buffers according to the prior art are disclosed, for example, in Japanese Patent Publication No. 60-21832 and Japanese Patent Application Laid-open No. 52-19376. These buffers have a rod, a piston, a cylinder, a throttle valve, and the like, and utilize as a buffering force a flowing resistance which occurs when oil flowing out from a cylinder chamber passes through the throttle valve, thereby reducing the noise of the breakthrough of the punch.

However, in order to effectively reduce noise by buffering the breakthrough of the punch, it is necessary to finely regulate the timing of the buffering against the timing of the blanking. A spacer is attached to the rod or the like for this regulation. Since an optimum timing varies depending on blanking conditions, such as the plate thickness, the shape and size of the punch, the material of the plate, the temperature, and the like, this method requires a worker to ascertain an optimum timing by trial and error each time any of the blanking conditions change, and to set the timing accordingly. Even when the optimum timing is set, a change of conditions (temperature, etc.) during blanking will cause the timing to deviate, with a resultant occurrence of a problem in actual use. Another problem is that utilizing a flowing resistance induced by throttling requires a slide to lower against the flowing resistance after the breakthrough of the punch, thus causing the press to do excess work.

FIG. 15A shows the load of a press in a conventional blanking state, i.e. the load exerted on the press at blanking. FIG. 15B shows an oil pressure in a buffer cylinder in the conventional blanking state, indicating that the pressure remains unchanged. FIG. 15C shows the displacement of a slide in the conventional blanking state. FIG. 15D shows the sound pressure of noise in the conventional blanking state, indicating that the noise level is higher. FIG. 16A shows the load of a press when buffering is performed using conventional throttling, indicating that the press does excess work, represented by the area W, after the breakthrough of the punch. FIG. 16B shows an oil pressure occurring in the buffer cylinder when buffering is performed using conventional throttling.

SUMMARY OF THE INVENTION

In view of the foregoing conventional problems, it is an object of the present invention to provide a breakthrough buffer for presses, capable of reducing noise occurring during blanking using a mechanical press and a control method therefor.

According to the present invention, the breakthrough buffer for presses for buffering the breakthrough of a punch occurring during blanking in a mechanical press comprises a buffer body disposed below the punch plate of the press and cushioning the punch plate during the breakthrough of the punch, a timing regulator connected to the buffer body and regulating the timing of the buffering during the breakthrough of the punch, and a controller adapted to send out a command for a regulating position to the timing regulator during the breakthrough of the punch.

Pipings from the buffer bodies are independently connected to the timing regulator, or are integrated into one piping and then connected to the timing regulator.

Moreover, the ratio of the cylinder diameter of the buffer body to a pipe diameter is so selected as to minimize a noise level.

In addition, in the control method for the breakthrough buffer for presses, the noise, or the vibration of a slide, or the like, occurring during the breakthrough of the punch is detected, and a command is sent out from the controller to the timing regulator to regulate the timing of the buffer body, whereby the noise or the vibration of the slide, or the like, is minimized.

According to the above construction, to regulate the timing of buffering, the noise, or the vibration of the slide, or the like correlating highly with noise, is detected at each blanking, and the controller averages a set of measurements to obtain a minimum average, and then outputs a command signal to the timing regulator. In response to the command signal, the timing regulator sets upper and lower positions for a buffer piston. By utilizing an action of hydraulic shock through an appropriate selection of a buffer piston diameter and the diameter of piping for connection with a tank, the load exerted on the press after the breakthrough of the punch is reduced more and thus more power is saved as compared with the conventional buffer utilizing a flowing resistance. This is because a hydraulic shock occurs in response to a quick movement, like the breakthrough of the punch, and hardly occurs when the slide lowers at a slower speed after the breakthrough of the punch.

BEST MODE FOR CARRYING OUT THE INVENTION

A breakthrough buffer for presses and a control method therefor according to a first embodiment of the present invention will now be described in detail with reference to the drawings.

Figure 1:
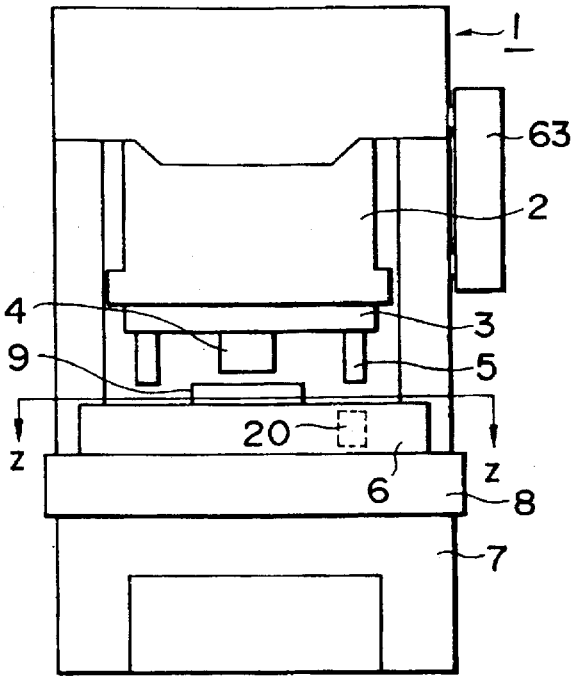
FIG. 1 is a front view which illustrates a press equipped with a breakthrough buffer according to a first embodiment of the present invention.
Figure 2:
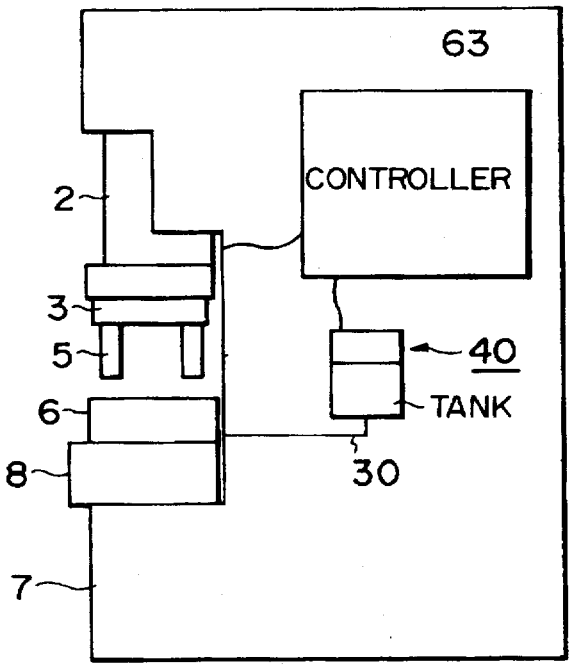
FIG. 2 is a side view of FIG. 1.

In a mechanical press 1 shown in FIGS. 1 and 2, a punch plate 3 is fixed on a punch holder slide 2, whose rising and lowering motions are driven by a driving mechanism (not shown) comprising a crank, a connecting rod, and the like. A punch 4 is attached to the punch plate 3, and also guideposts 5 are fixed to the punch plate 3. A die block 6 opposed to the punch plate 3 is attached to a press frame 7 through a bolster 8. A die 9 is attached to the die block 6.

Figure 3:
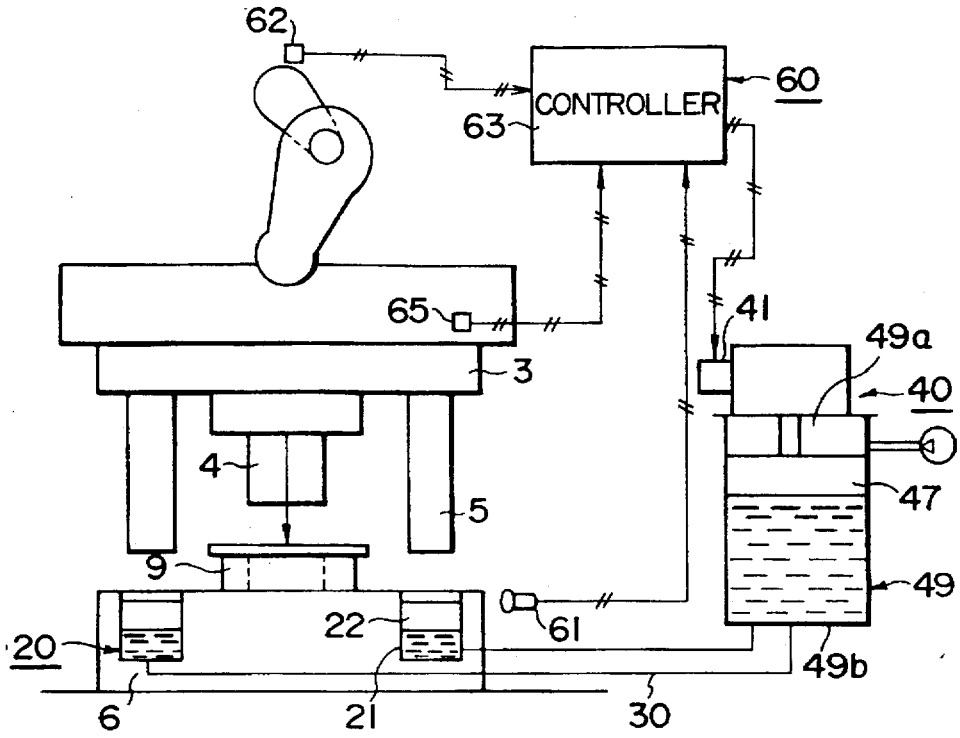
FIG. 3 is a conceptual diagram which illustrates the breakthrough buffer and the controller according to the first embodiment.

A buffer body 20 cushioning the punch plate 3 during the breakthrough of the punch is disposed in the die block 6 of the mechanical press 1, opposed to a guidepost 5 fixed to the punch plate 3. A timing regulator 40, for regulating the timing of the buffer body 20 during the breakthrough of the punch, is connected to the buffer body 20 through a piping 30. As shown in FIG. 3, a control system 60 sends out a control signal to the timing regulator 40 for regulating a timing position during the breakthrough of the punch.

The buffer body 20 comprises a buffer cylinder 21 and a buffer piston 22. A plurality of buffer bodies 20 are disposed below the punch plate 3 and in the die block 6.

Figure 4:
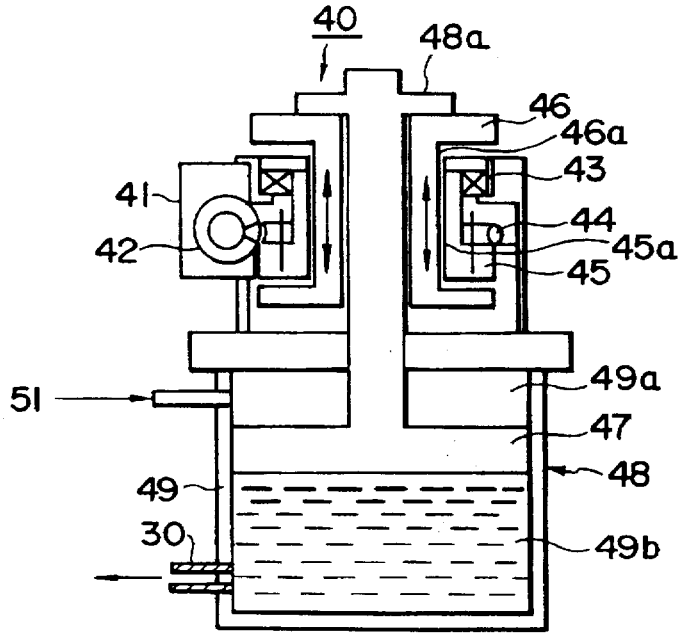
FIG. 4 is a front view which illustrates a timing regulator according to the first embodiment.
Figure 5:
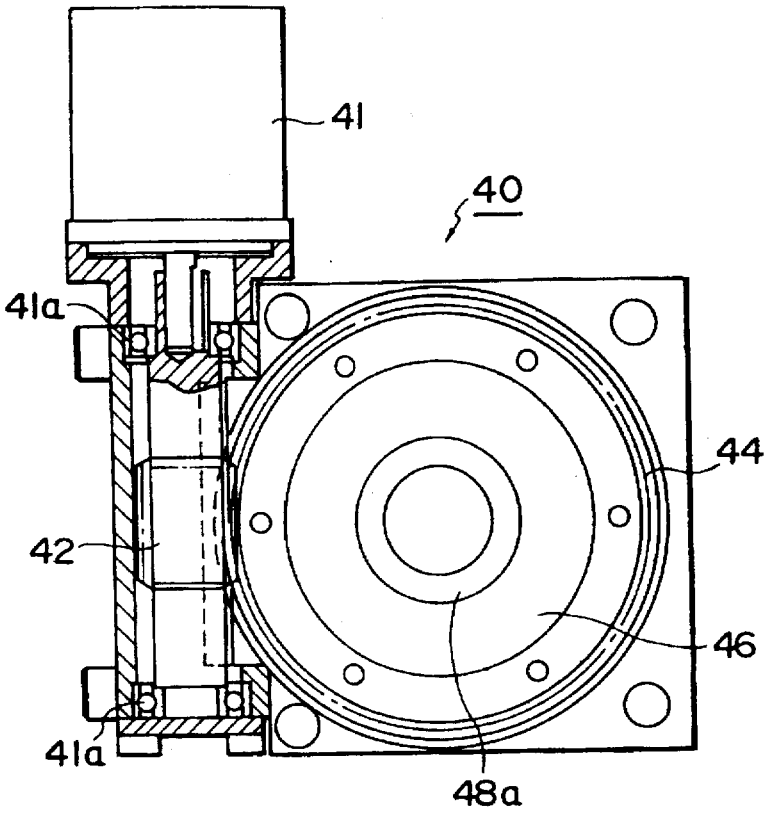
FIG. 5 is a plan view which illustrates the timing regulator according to the first embodiment.
Figure 6:
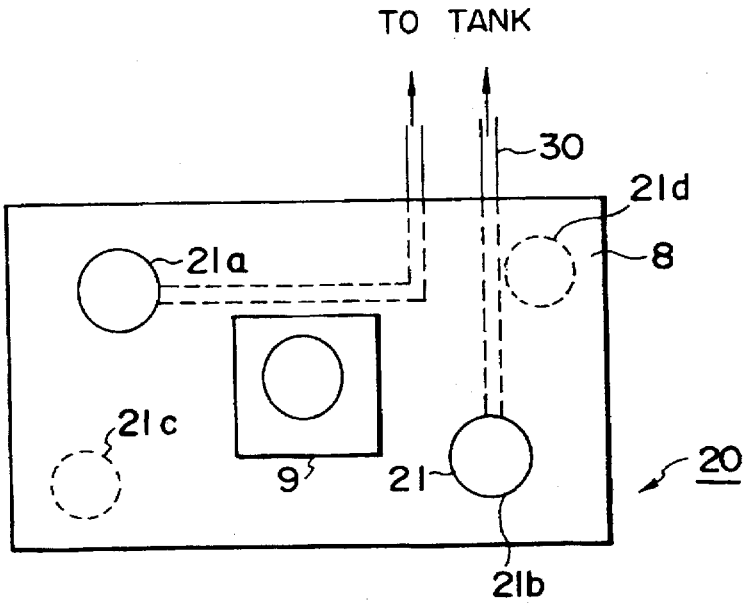
FIG. 6 is a cross-sectional view along the line Z—Z of FIG. 1.

FIGS. 4 and 5 show the timing regulator 40 in detail. The timing regulator 40 comprises: a stepping motor 41, which runs under a command from the control system 60; a worm gear 42, which is supported by bearings 41*a* at both ends and is rotated by the stepping motor 41; a worm wheel 44, which rotates a nut 45 held rotatably by a bearing 43 at one end and engages with the worm gear 42; a guide 46 with external threads 46*a* which engage with internal threads 45*a* of the rotating nut 45 and moves upwardly/downwardly through the rotation of the nut 45; a buffering timing regulating piston 48, which has a radially extending flange 48*a* abutting on the guide 46 at one end and a piston 47 at the other end; and a tank 49, which houses the buffering timing regulating piston 48, maintains an air pressure in an air chamber 49*a* located on one side of the buffering timing regulating piston 48, and contains oil in an oil chamber 49*b* located on the other side. A piping 51 leading to an air source (not shown) is connected to the tank 49 at one end, and a piping 30 leading to the buffer body 20 is connected at the other end. The guide 46 is provided with a locking mechanism to restrain trailing whirl.

As exemplified in FIG. 3, two buffer bodies 20 are disposed in the die block 6, opposed to the guideposts 5. The pipings 30 from the buffer cylinders 21 of the buffer bodies 20 are independently connected to the tank 49. Pipings from the buffer bodies 20 can be integrated into one piping before the timing regulator 40 and connected to the tank 49. Each buffer body 20 can be disposed in the bolster 8 and connected directly to the tank 49 for utilizing hydraulic buffering more effectively.

At this time, when the buffer cylinder 21 and the tank 49 are connected through the piping 30 and when two buffer cylinders 21, i.e. 21*a* and 21*b* are used, the ratio of buffer cylinder diameter to the piping diameter is set substantially at 10:1 for a reason described later. When four buffer cylinders 21, i.e. 21*a*, 21*b*, 21*c* and 21*d* are used, the ratio of buffer cylinder diameter to the piping diameter is set substantially at 3:1.

The control system 60, as shown in FIG. 3, comprises a noise meter 61 to measure noise occurring during the breakthrough of the punch, an angle detector 62 to detect the rotation angle of a crank, and a controller 63 which regulates the timing of each buffer body 20 based on signals from these meters 61, 62 and sends out a next command to the stepping motor 41 of the timing regulator 40 for minimizing noise. The controller 63 is disposed on the press frame 7. Noise occurring during the breakthrough of the punch is measured here, but the vibration of the slide, or the like, can be measured with an accelerometer 65 for exercising control so as to reduce vibration.

Regulating operations of the timing regulator 40 will now be described.

As shown in FIGS. 4 and 5, in the timing regulator 40, when the stepping motor 41 receives a command signal from the controller 63, the stepping motor 41 rotates a certain angle, causing the worm gear 42 to rotate. Accordingly, the worm wheel 44 and the nut 45 rotate about the shaft of the regulating piston 48 by a fixed angle according to the gear ratio between the worm gear 42 and the worm wheel 44. As a result, as the nut 45 with internally incised threads 45*a* rotates, the guide 46 with the external threads 46*a* engaged with the threads 45*a* moves upwardly/downwardly by a certain fixed distance. As the guide 46 moves upwardly/downwardly, the radially extending flange 48*a* abutting thereon moves upwardly/downwardly.

At this time, the air chamber 49*a* of the tank 49 always maintains an air pressure of about 5 kg/cm$^2$, and hence the regulating piston 48 is normally pressed downwardly. Thus, the top face of the guide 46 serves as a stopper against the radially extending flange 48*a* of the regulating piston 48, thereby determining the lower limit position of the regulating piston 48. Accordingly, oil in the oil chamber 49*b* of the tank 49 moves to the buffer cylinder 21 through the piping 30, thereby determining the upper limit position of the buffer piston 22. Thus, the upper limit position of the buffer piston 22 for maintaining an optimum state with a minimum noise at all times can be set automatically without manual operations.

Figure 7:
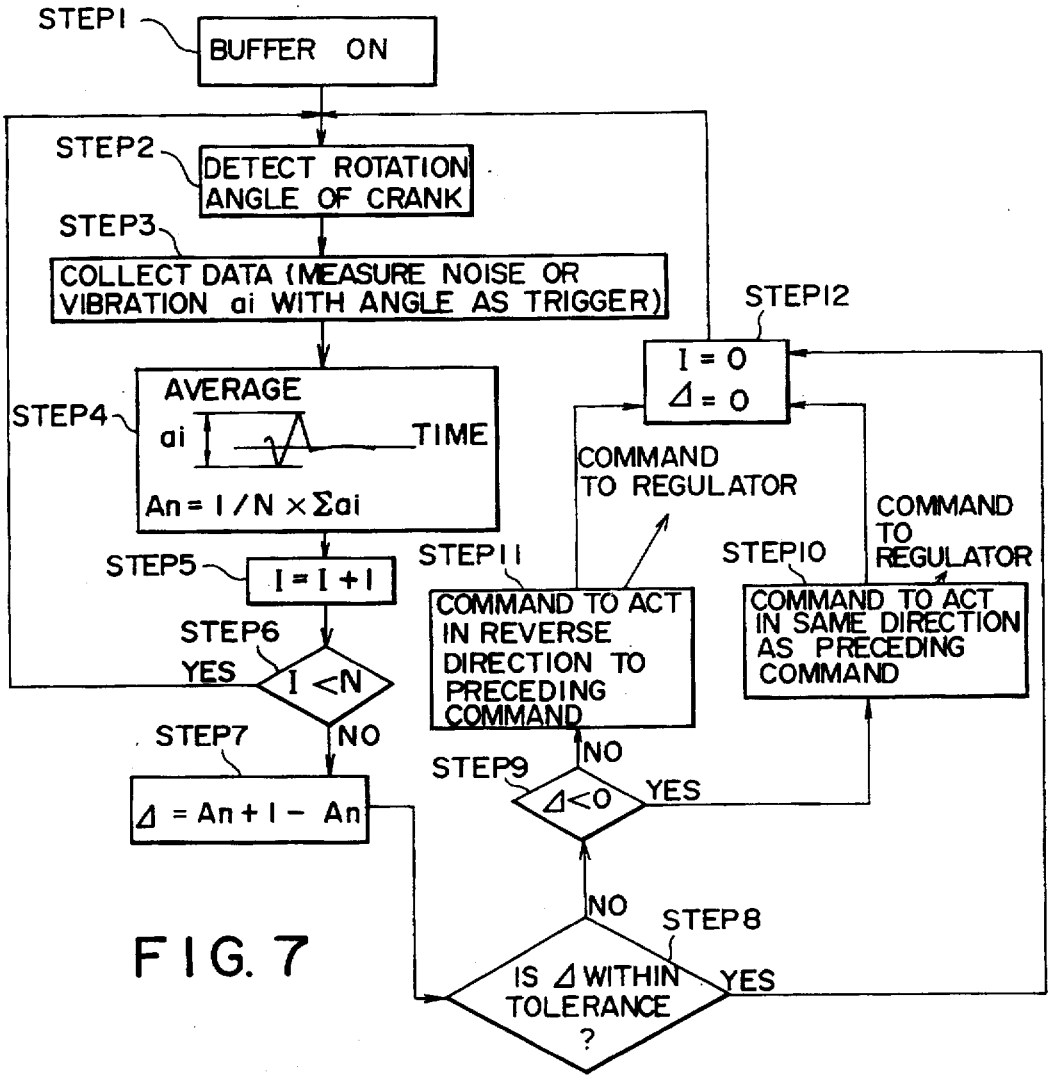
FIG. 7 is a flow chart which illustrates a control method according to the present invention.

A method of issuing a command of a setting position in the first embodiment will now be described with reference to a flow chart in FIG. 7.

First, at step 1, when operation starts, the controller 63 enters an active state. At step 2, the controller 63 receives a signal indicative of the angle of a crank from the angle detector 62 of the press. At step 3, noise or vibration ai is measured at each blanking, using the angle signal as a trigger. At step 4, the controller 63 calculates an average of values measured at N times of blanking ($An=1/N\times\Sigma ai$). At steps 5 and 6, noise ai is measured at each subsequent blanking in the same manner until the blanking count reaches N. The controller 63 calculates an average of thus measured values ($An+1=1/N\times\Sigma ai$). At step 7, the difference $\Delta$ between the average value An+1 and the preceding average value An is obtained.

At step 8, if the difference $\Delta$ is within a tolerance, the controller 63 goes to step 12 without sending out a command signal to the timing regulator 40. If the difference $\Delta$ does not fall within the tolerance at step 8, the controller 63 goes to step 9 and determines, from a magnitude or a plus/minus sign of the difference $\Delta$, a command signal to be sent out to the timing regulator 40. If the difference $\Delta$ is smaller than zero, at step 10, the controller 63 outputs to the timing regulator 40 a command to act in the same direction as the preceding command. On the other hand, if the difference Δ is greater than zero, at step 11, the controller 63 outputs to the timing regulator 40 a command signal to act in the reverse direction to the preceding command signal. Then, the controller 63 repeats the operation of step 10 or 11 and outputs to the timing regulator 40 a command signal indicative of the timing of buffering when the difference Δ has become zero, i.e. when noise has been minimized (step 12).

Figure 8:
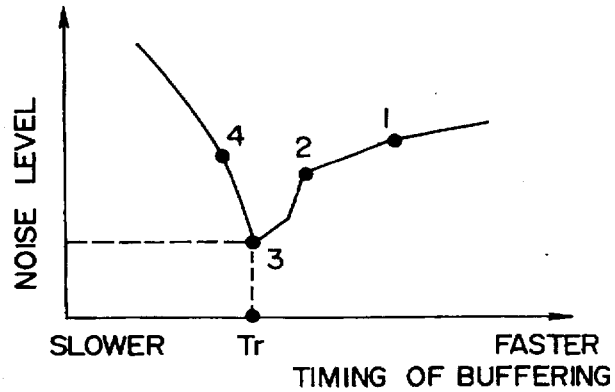
FIG. 8 is a graph which illustrates the relationship between the timing of buffering and the noise level.

For example, as shown in FIG. 8, suppose that obtaining measurement data on point No. 1, the controller 63 has outputted to the timing regulator 40 a next command to delay the timing of buffering and thus has caused the buffer piston 22 to move slower, and then has obtained next data on point No. 2. In this case, since the difference between noise levels No. 1 and No. 2 is smaller than zero, the next command is to act in the same direction as the preceding command, i.e. in such a direction as to delay the timing of buffering.

Likewise, suppose that a noise level at this time has been measured and a noise level No. 3, lower than noise level No. 2, has been obtained. This operation continues until the noise level is inverted, i.e. until the difference between the currently measured noise level and the previously measured noise level exceeds zero. The noise level No. 4 is inverted, indicating that the noise level No. 3 is a minimum value. Hence, the controller 63 outputs to the timing regulator 40 such a command as to set the timing of buffering to the one corresponding to the noise level No. 3, i.e. Tr, thereby regulating the position of the buffer piston 22 accordingly. As a result, the minimum noise level is obtained.

Figure 9:
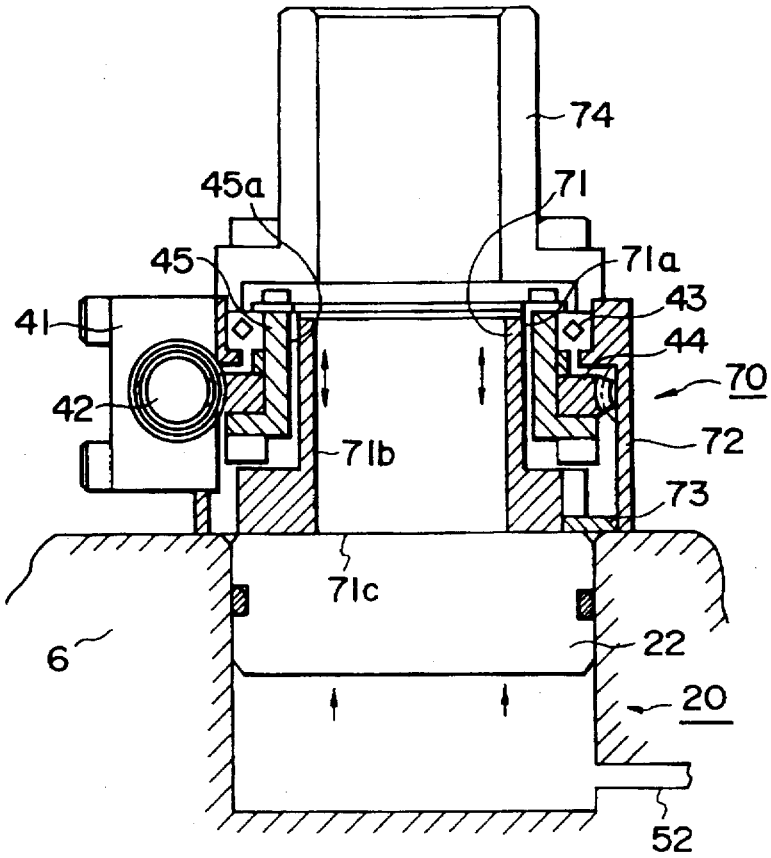
FIG. 9 is a front view which illustrates a timing regulator according to a second embodiment.

A second embodiment of the present invention will now be described with reference to FIG. 9. The same features as in the first embodiment are denoted by common reference numerals, and their description is omitted.

The timing regulator 70 abuts on the buffer piston 22 of the buffer body 20 and is disposed on the top face of the die block 6. In details, externally incised threads 71*a* of a guide 71 engage with internal threads 45*a* of the nut 45 fixed to the worm wheel 44. As the nut 45 rotates, the guide 71 moves upwardly/downwardly with its bottom face 71*c* abutting on the buffer piston 22. A hole 71*b* is cut in the guide 71 at its central portion to allow the guidepost 5 to pass therethrough. When in operation, the end portion of the guidepost 5 abuts on the buffer piston 22. The guide 71 is provided with a keyway-like locking mechanism 73 to restrain the guide 71 from rotating with respect to a case 72, thereby allowing the guide 71 to slide only in the vertical direction. The bearing 43 is fixed to the timing regulator 70, and a guide member 74 for guiding the guidepost 5 is attached to the case 72 at its top end. The bottom end of the case 72 is attached to the top face of the die block 6.

In such a construction, the guide 71 of the timing regulator 70 determines directly the position of the buffer piston 22 of the buffer body 20 in the vertical direction. In other words, the buffer piston 22 is pushed up by air having a pressure of about 5 kg/cm$^2$ and supplied from a tank (not shown) through a piping 52. The bottom face 71*c* of the guide 71 abutting on the buffer piston 22 serves as a stopper to determine the upper limit position of the buffer piston 22. A required stroke of the buffer piston 22 is about 10 mm.

Figure 10:
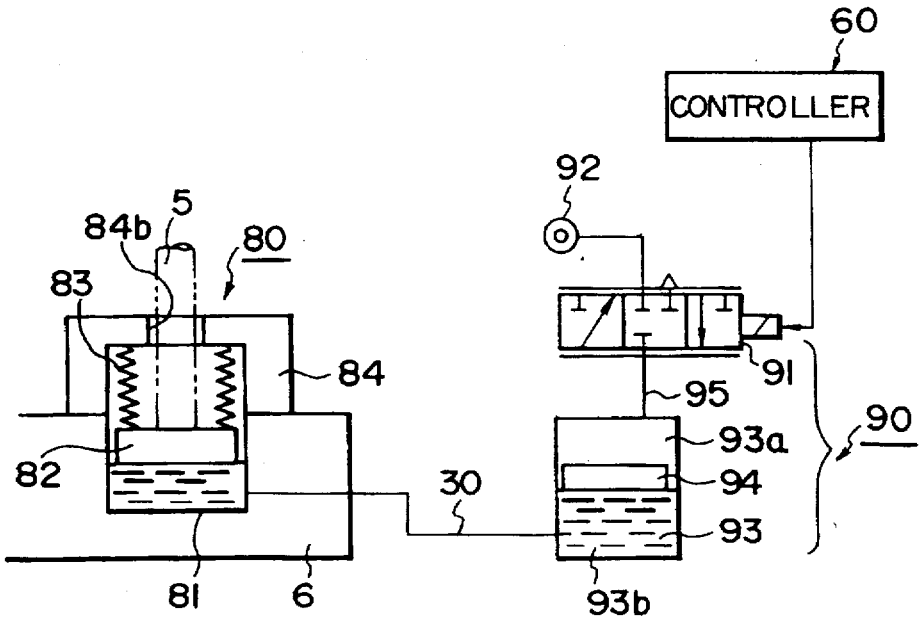
FIG. 10 is a conceptual diagram which illustrates a timing regulator according to a third embodiment.

A third embodiment of the present invention will now be described with reference to FIG. 10. The same features as in the first embodiment are denoted by common reference numerals, and their description is omitted.

A buffer body 80 to cushion the punch plate 3 during the breakthrough of the punch is disposed on the die block 6, opposed to the guidepost 5. A timing regulator 90, for regulating the timing of the buffer body 80 at the breakthrough of the punch, is connected to the buffer body 80 through the piping 30. The control system 60 sends out a control command to the timing regulator 90, thereby exercising control.

The buffer body 80 comprises a buffer cylinder 81, a buffer piston 82, a spring 83 to press the buffer piston 82, and a case 84 to accommodate the spring 83. A plurality of buffer bodies 80 are disposed in the die block 6. A hole 84*b* is cut in the case 84 at its central portion to allow the guidepost 5 to pass therethrough. In operation, the end portion of the guidepost 5 abuts on the buffer piston 82.

The timing regulator 90 comprises an electromagnetic proportional selector valve 91 which operates under a command from the control system 60 and an air-oil actuator 93, which receives an air pressure from a pump 92 through the electromagnetic selector valve 91 and sends pressure oil to the buffer body 80. A piston 94 is disposed in the air-oil actuator 93. Air is contained in an air chamber 93*a* on one side of the piston 94, and oil is contained in an oil chamber 93*b* on the other side of the piston 94. The air chamber 93*a* is connected to the electromagnetic proportional selector valve 91 through a piping 95, and the oil chamber 93*b* is connected to the buffer cylinder 81 through the piping 30.

In such a construction, an oil pressure and a spring force exerted on the buffer piston 82 determine the position of the buffer piston 82 in the vertical direction. In other words, the electromagnetic proportional selector valve 91 is controlled by a command from the control system 60 to bring the air pressure of the air chamber 93*a* to Pa. At this time, with the pressure exerted area of the air chamber 93*a* taken as Sa and the pressure exerted area of the oil chamber 93*b* as Sh, the oil pressure Ph of the oil chamber 93*b* is expressed by $$Ph=Pa\times Sa/Sh$$

This oil pressure Ph acts on the bottom face of the buffer piston 82.

With the spring constant of a spring 83 acting on the buffer piston 82 taken as K, a deflection from a free length as y, and the pressure exerted area of the buffer piston 82 as Sp, the deflection y of the spring 83 is expressed by $$y=-Ph\times Sp/K$$

An equilibrium state is established at a predetermined position. Hence, by controlling the air pressure Pa with the electromagnetic proportional selector valve 91, the deflection y of the spring 83 is controlled, and thus the position of the buffer piston 82 can be controlled.

In the above description, an air pressure is used at one end, but it can be replaced with an oil pressure. Also, the air pressure at one end is controlled with the electromagnetic proportional selector valve 91; but with the air pressure at one end enclosed, an oil pressure at the other end can be controlled with the electromagnetic proportional selector valve 91. Moreover, the electromagnetic proportional selector valve 91 can be replaced with an electromagnetic proportional pressure control valve.

Figure 11:
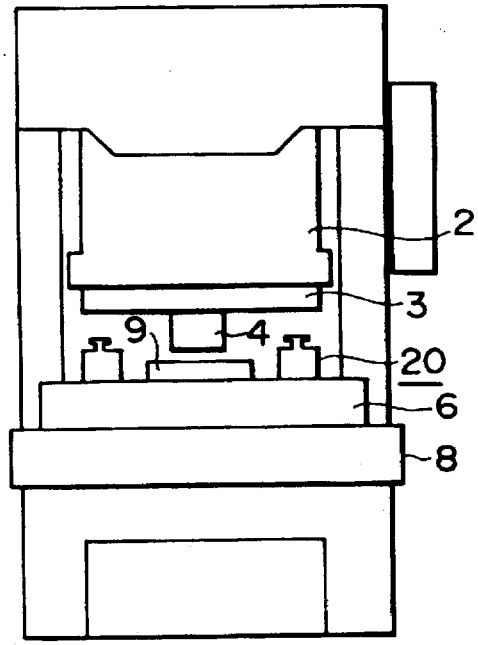
FIG. 11 is a front view which illustrates an applied example of a press equipped with the breakthrough buffer.
Figure 12:
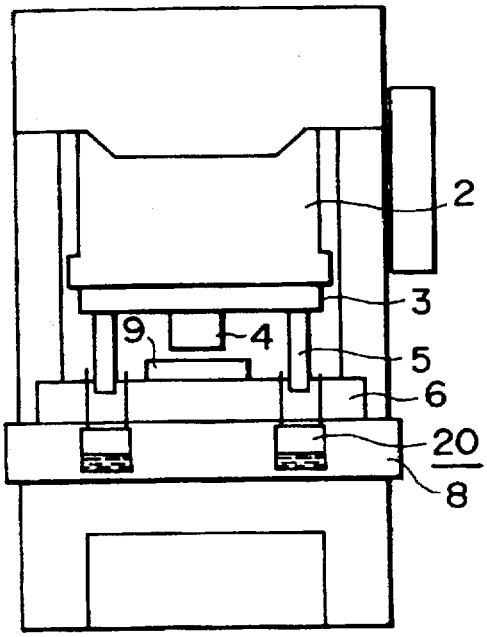
FIG. 12 is a front view which illustrates another applied example of a press equipped with the breakthrough buffer.

In the above description, the buffer bodies 20, 80 are placed in the die block 6, but it is not necessary for them to be placed in the die block 6. As shown in FIG. 11, the buffer body 20 can be placed between the punch plate 3 and the die block 6. Alternatively, (not shown) the buffer body 20 can be placed between the slide 2 and the bolster 8. Also, as shown in FIG. 12, the buffer body 20 can be placed in the bolster 8.

The ratio between the bore diameter D of the buffer cylinder 21 and the diameter d of the piping 30 connecting the buffer cylinder 21 and the tank 49 will now be described.

Figure 13:
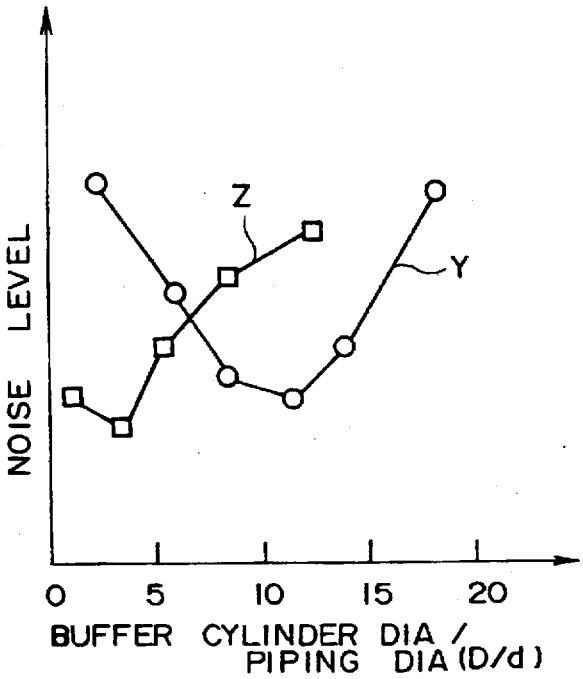
FIG. 13 is a graph which illustrates the relationship between the noise level and the ratio of a buffer cylinder diameter to a piping diameter.

As a result of conducting a study at various ratios between the bore diameter D of the buffer cylinder 21 and the diameter d of the piping 30, data as shown in FIG. 13 were obtained. It was found that a noise level was minimized at a ratio of about 10:1, as represented with curve Y, when two buffer cylinders 21 were used, and that a noise level was minimized at a ratio of about 3:1, as represented with curve Z, when four buffer cylinders 21 were used.

Figure 14A:
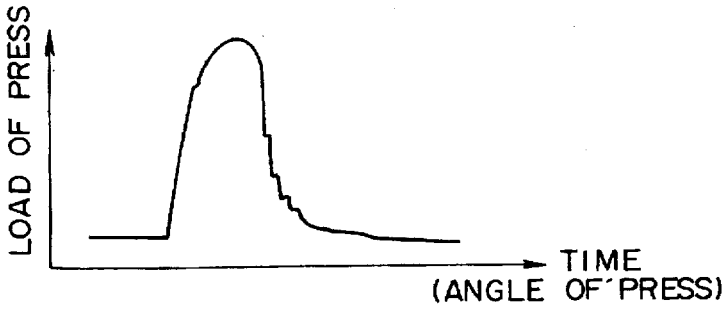
FIGS. 14A–14D are graphs which illustrate effects of the present embodiment.
Figure 14B:
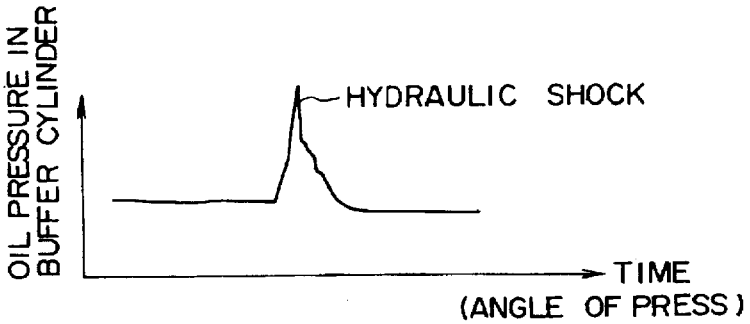
Figure 14C:
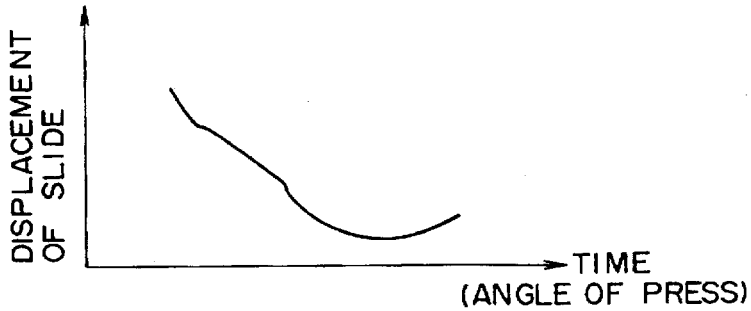
Figure 14D:
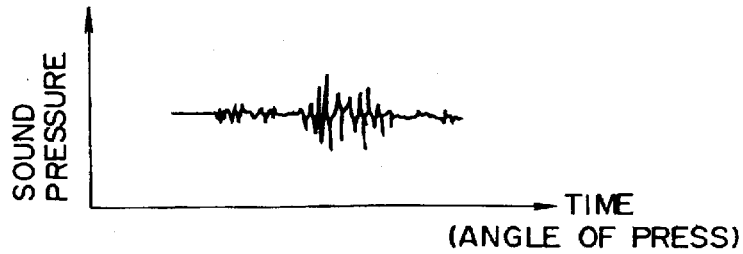

Also, the load of the press 1, an oil pressure in the buffer cylinder 21, the displacement of the slide 2, and the noise were measured. FIG. 14A shows the load of the press 1 versus the elapse of time (or a change of the angle of the crank). FIG. 14B shows the oil pressure in the buffer cylinder 21. FIG. 14C shows the displacement of the slide 2. FIG. 14D shows the sound pressure of a noise level.

Figure 15A:
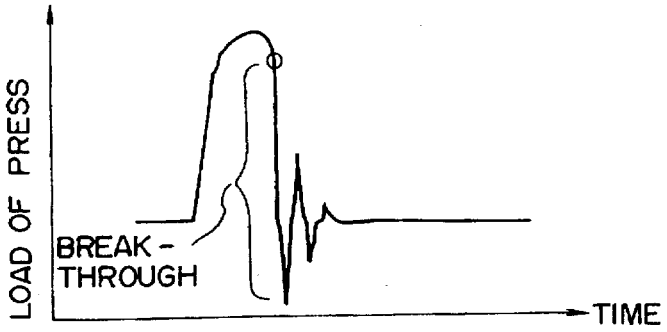
FIG. 15A PRIOR ART
FIGS. 15A–15D are graphs which illustrate effects of the prior art.
Figure 15B:
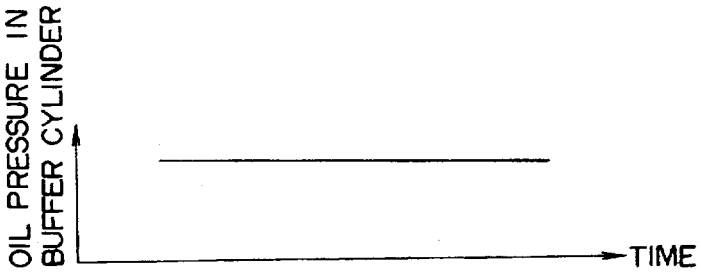
FIG. 15B PRIOR ART
Figure 15C:
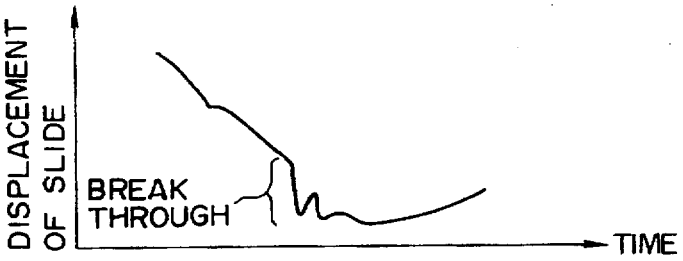
FIG. 15C PRIOR ART
Figure 15D:
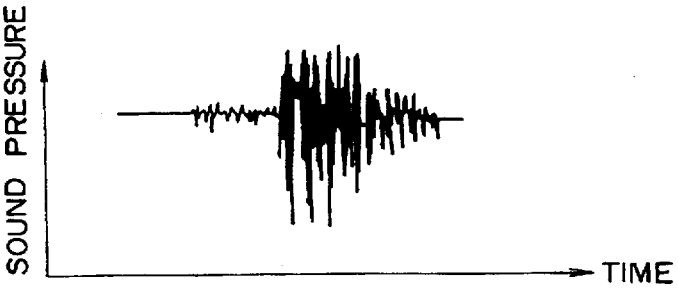
FIG. 15D PRIOR ART
Figure 16A:
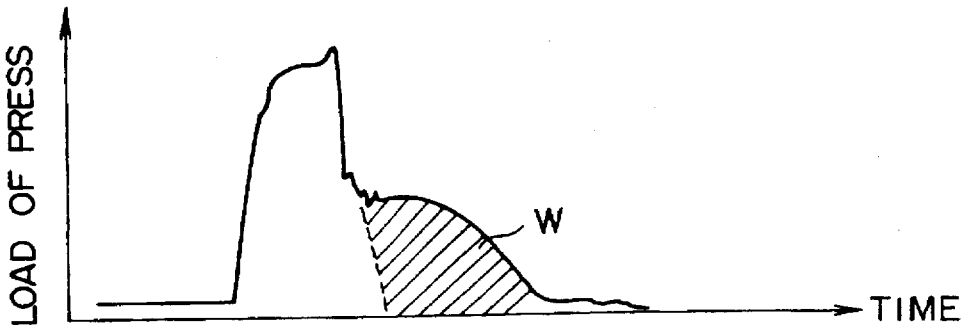
FIG. 16A PRIOR ART
FIGS. 16A–16B are graphs which illustrate other effects of the prior art.
Figure 16B:
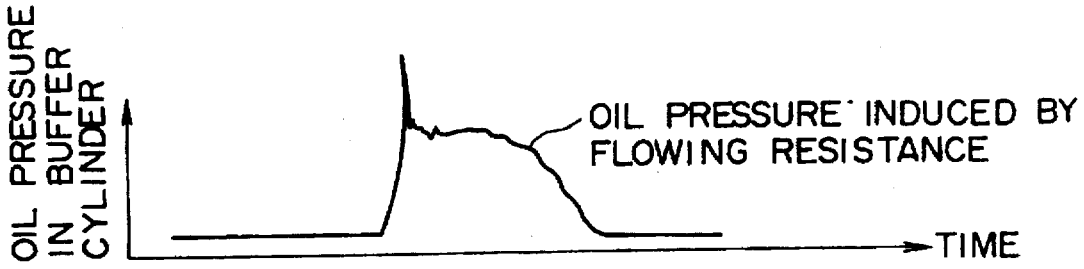
FIG. 16B PRIOR ART

As seen from the above figures, a sound pressure level having a lower amplitude is obtained as compared with the sound pressure of the prior art system as shown in FIG. 15D and described before. Also, as compared with a load exerted on a press reducing noise by conventional throttling as shown in FIG. 16A and described before, an excess load represented by shaded area W does not exist, and thus the load of the press can be reduced after the breakthrough of the punch.

According to the present embodiment, by utilizing the action of hydraulic shock instead of throttling and by selecting as appropriate the bore diameter D of the buffer cylinder 21 and the diameter d of the piping 30 connecting the buffer cylinder 21 and the tank 49, the hydraulic shock can be used effectively. Moreover, since the hydraulic shock occurs in response to a quick movement, the hydraulic shock occurs only during the breakthrough of the punch and hardly occurs at a subsequent stage where the slide moves downwardly at a slower speed. Hence, the load of the press after the breakthrough of the punch can be reduced, and power can be saved.

INDUSTRIAL APPLICABILITY

The present invention is effective to serve as a breakthrough buffer for presses and a control method therefor capable of automatically obtaining a low noise level, capable of further reducing the low noise level by selecting as appropriate the diameter of a buffer piston and the diameter of piping connecting the buffer piston and a tank, and capable of reducing the load of the press after the breakthrough of the punch, thus saving power.

What is claimed is:

1. A mechanical press having a punch plate, a press frame, a punch mounted in said punch plate, at least one guidepost, and a breakthrough buffering apparatus for buffering a breakthrough of said punch occurring during a blanking operation, said buffering apparatus comprising:

at least one buffer body disposed below said punch plate of said press so as to receive a respective guidepost to cushion said punch plate during a breakthrough of said punch;

at least one timing regulator, said at least one timing regulator being connected to said at least one buffer body and regulating a timing of buffering by said at least one buffer body during a breakthrough of said punch; and a control system for providing a regulating position command to each of said at least one timing regulator to control each of said at least one buffer body during a breakthrough of said punch;

wherein each said at least one timing regulator comprises a casing forming a regulating cylinder, a regulating piston positioned in said regulating cylinder to provide a first fluid chamber on one side of said regulating piston, and means for moving said regulating piston responsive to said regulating position command to thereby vary a fluid pressure in said first fluid chamber, and further comprising piping connecting said first fluid chamber to each of said at least one buffer body to control each said at least one buffer body, during a breakthrough of said punch, responsive to said fluid pressure in said first fluid chamber.

2. A mechnical press in accordance with claim 1, wherein said regulating piston comprises a piston shaft having a piston head at one end of said piston shaft and a radially extending flange at another end of said piston shaft, said first fluid chamber being on a side of said piston head opposite to said piston shaft, a guide positioned adjacent to said piston shaft so as to be adapted to move said piston shaft in a vertical direction, and means for vertically moving said guide responsive to said regulating position command.

3. A mechanical press in accordance with claim 2, wherein said radially extending flange has a bottom face, wherein said guide is an annular member surrounding said piston shaft, wherein said guide has a top face, and wherein at a lower limit of a vertical movement of said regulating piston said bottom face of said radially extending flange contacts said top face of said guide, so that a resulting contact of said bottom face of said radially extending flange with said top face of said guide determines said lower limit of said vertical movement.

4. A mechanical press in accordance with claim 3, a second fluid chamber in said regulating cylinder on a side of said regulating piston opposite to said first fluid chamber, and means for providing pressurized fluid to said second fluid chamber to bias said regulating piston toward said first fluid chamber so that said bottom face of said radially extending flange is biased into contact with said top face of said guide.

5. A mechanical press in accordance with claim 4, wherein said means for vertically moving said guide responsive to said regulating position command comprises a worm wheel for moving said guide vertically, a worm gear in engagement with said worm wheel, and a stepping motor for driving said worm gear responsive to said regulating position command.

6. A mechanical press in accordance with claim 5, wherein said guide has external threads, further comprising a nut surrounding said guide and having internal threads in engagement with said external threads of said guide, said nut being associated with said worm wheel so as to be rotatable by said worm wheel.

7. A mechanical press in accordance with claim 6, wherein each buffer body comprises a buffer cylinder having a buffer piston positioned therein to form a buffering chamber, said buffer piston being engagable by said respective guidepost in opposition to fluid pressure in said buffering chamber, and wherein said piping connects said first fluid chamber to each buffering chamber so as to cushion said respective guidepost and said punch plate during a breakthrough of said punch.

8. A mechanical press in accordance with claim 7, wherein each said buffer cylinder has a diameter, wherein each piping connecting a buffer cylinder to said at least one timing regulator has a diameter, and wherein a ration of a diameter of a buffer cylinder has diameter of a piping connecting that buffer cylinder and said at least one timing regulator is selected so that the resulting connection of that buffer cylinder and that piping serves to minimize a noise level of said press during a breakthrough of said punch.

9. A mechanical press having a punch plate, a press frame, a punch mounted in said punch plate, at least one guidepost, and a breakthrough buffering apparatus for buffering a breakthrough of said punch occurring during a blanking operation, said buffering apparatus comprising:

at least one buffer body disposed below said punch plate of said press so as to receive a respective guidepost to cushion said punch plate during a breakthrough of said punch;

at least one timing regulator, said at least one timing regulator being connected to said at least one buffer body and regulating a timing of buffering by said at least one buffer body during a breakthrough of said punch; and a control system for providing a regulating position command to each of said at least one timing regulator to control each of said at least one buffer body during a breakthrough of said punch;

wherein each said at least one buffer body comprises a buffer cylinder having a buffer piston positioned therein to form a buffering chamber;

wherein each said at least one guidepost has a bottom face; and wherein each of said at least one timing regulator is associated with a respective one of said at least one buffer body, each of said at least one timing regulator comprising:

a guide having one end abutting a corresponding buffer piston, said guide having an opening in its central portion to allow a corresponding guidepost to enter therein so that at a time of breakthrough by said punch said bottom face of said corresponding guidepost abuts on said corresponding buffer piston in opposition to fluid pressure in said buffering chamber;

means for providing pressurized fluid to said buffering chamber to bias said corresponding buffer piston against said one end of said guide; and means for vertically moving said guide responsive to said regulating position command, said one end of said guide constituting an upper limit position of said corresponding buffer piston;

wherein said means for vertically moving said guide responsive to said regulating position command comprises a worm wheel for moving said guide vertically, a worm gear in engagement with said worm wheel, and a stepping motor for driving said worm gear responsive to said regulating position command.

10. A mechanical press in accordance with claim 9, wherein said guide has external threads, further comprising a nut surrounding said guide and having internal threads in engagement with said external threads of said guide, said nut being associated with said worm wheel so as to be rotatable by said worm wheel.

11. A mechanical press in accordance with claim 9, further comprising a locking mechanism for restraining any trailing whirl of said guide.

12. A mechanical press having a punch plate, a press frame, a punch mounted in said punch plate, at least one guidepost, and a breakthrough buffering apparatus for buffering a breakthrough of said punch occurring during a blanking operation, said buffering apparatus comprising:

at least one buffer body disposed below said punch plate of said press so as to receive a respective guidepost to cushion said punch plate during a breakthrough of said punch;

at least one timing regulator, said at least one timing regulator being connected to said at least one buffer body and regulating a timing of buffering by said at least one buffer body during a breakthrough of said punch: and a control system for providing a regulating position command to each of said at least one timing regulator to control each of said at least one buffer body during a breakthrough of said punch;

wherein each said at least one timing regulator comprises a casing forming a regulating cylinder, a regulating piston positioned in said regulating cylinder to provide a first fluid chamber on one side of said regulating piston and a second fluid chamber on an opposite side of said regulating piston, and means for providing pressurized fluid to said second fluid chamber to move said regulating piston responsive to said regulating position command to thereby vary a fluid pressure in said first fluid chamber, and further comprising piping connecting said first fluid chamber to each of said at least one buffer body to control each of said at least one buffer body, responsive to said fluid pressure in said first fluid chamber, during a breakthrough of said punch:

wherein said means for providing pressurized fluid comprises a source of pressurized fluid and an electromagnetic proportional selector valve connected between said source of pressurized fluid and said second fluid chamber, and wherein said regulating position command is provided to said electromagnetic proportional selector valve so that a position of the electromagnetic proportional selector valve being determined in response to said regulating position command.

13. A mechanical press in accordance with claim 12, wherein each said at least one buffer body comprises a buffer cylinder having a buffer piston positioned therein to form a buffering chamber, said buffer piston being engagable by a respective guidepost in opposition to fluid pressure in said buffering chamber, a spring biasing said buffer piston toward said buffering chamber, and wherein said piping connects said first fluid chamber to each buffering chamber so as to cushion a respective guidepost and said punch plate during a breakthrough of said punch.

14. A method for buffering a breakthrough of a punch occurring during blanking in a mechanical press, said method comprising:

detecting a value of one of (a) noise occurring during a breakthrough of said punch and (b) vibration of a punch slide occurring during a breakthrough of said punch, establishing a command signal responsive to the thus detected value, buffering a movement of said punch, and regulating a timing of said buffering to reduce said one of (a) noise occurring during a breakthrough of said punch and (b) vibration of said slide occurring during a breakthrough of said punch.

15. A method in accordance with claim 14, wherein said step of establishing a command signal comprises:

calculating an average of the thus detected value measured at N occasions of blanking, detecting a value of said one at an N+1 blanking, calculating an average of the thus detected value measured at N+1 occasions of blanking, determining a difference between the thus calculated average at N occasions of blanking and the thus calculated average at N+1 occasions, determining whether the thus determined difference is within a tolerance, if the thus determined difference is not within said tolerance, determining whether a desired direction of change in said timing of buffering should be in a direction which is same as a direction of a preceding command signal or in a direction which is opposite to a direction of said preceding command signal, and transmitting a next command signal for a desired direction of change in said timing of said buffering.

16. A mechanical press having a punch plate, a press frame, a punch mounted in said punch plate, at least one guidepost, and a breakthrough buffering apparatus for buffering a breakthrough of said punch occurring during a blanking operation, said buffering apparatus comprising:

at least one buffer body disposed below said punch plate of said press so as to receive a respective guidepost to cushion said punch plate during a breakthrough of said punch;

at least one timing regulator, said at least one timing regulator being connected to said at least one buffer body and regulating a timing of buffering by said at least one buffer body during a breakthrough of said punch; and a control system for providing a regulating position command to each of said at least one timing regulator to control each of said at least one buffer body during a breakthrough of said punch;

wherein each said at least one timing regulator comprises a casing forming a regulating cylinder, a regulating piston positioned in said regulating cylinder to provide a first fluid chamber on one side of said regulating piston and a second fluid chamber on an opposite side of said regulating piston, and means for providing pressurized fluid to said second fluid chamber to move said regulating piston responsive to said regulating position command to thereby vary a fluid pressure in said first fluid chamber, and further comprising piping connecting said first fluid chamber to each of said at least one buffer body to control each of said at least one buffer body, responsive to said fluid pressure in said first fluid chamber, during a breakthrough of said punch.

* * * * *

UNITED STATES PATENT AND TRADEMARK OFFICE

CERTIFICATE OF CORRECTION

PATENT NO. : 5,673,601

DATED : October 7, 1997

INVENTOR(S) : Ejima et al

It is certified that error appears in the above-indentified patent and that said Letters Patent is hereby corrected as shown below:

Column 9, line 1, delete "ration" and insert --ratio--.

Column 9, line 2, delete "has" and insert --to a--.

Signed and Sealed this

Tenth Day of March, 1998

Bruce Lehman

*Attest:*

BRUCE LEHMAN

*Attesting Officer*

*Commissioner of Patents and Trademarks*